US011274516B2

(12) United States Patent
Allison et al.

(10) Patent No.: US 11,274,516 B2
(45) Date of Patent: Mar. 15, 2022

(54) METHODS AND SYSTEMS FOR A FISHING TOOL

(71) Applicant: Vertice Oil Tools, Missouri City, TX (US)

(72) Inventors: Justin Allison, Tulsa, OK (US); Michael Lo, Missouri City, TX (US); Mohamed Ibrahim Saraya, Sugar Land, TX (US)

(73) Assignee: Vertice Oil tools Inc., Stafford, TX (US)

( * ) Notice: Subject to any disclaimer, the term of this patent is extended or adjusted under 35 U.S.C. 154(b) by 187 days.

(21) Appl. No.: 16/705,646

(22) Filed: Dec. 6, 2019

(65) Prior Publication Data

US 2021/0169059 A1 Jun. 10, 2021

(51) Int. Cl.
*E21B 31/18* (2006.01)

(52) U.S. Cl.
CPC ..... *E21B 31/18* (2013.01)

(58) Field of Classification Search
CPC ..... E21B 31/18
See application file for complete search history.

(56) References Cited

U.S. PATENT DOCUMENTS 1,454,819 A * 5/1923 Jones ..... E21B 31/18 166/55.6
1,660,449 A * 2/1928 Kinney ..... E21B 31/18 294/86.3
1,661,638 A * 3/1928 Spang ..... E21B 31/18 294/86.2
1,780,134 A * 10/1930 Le Bus ..... E21B 31/18 294/86.31
1,785,152 A * 12/1930 Stone ..... E21B 31/18 294/86.3
3,393,002 A * 7/1968 Woolley ..... E21B 31/18 294/86.23
4,662,436 A * 5/1987 Parra ..... E21B 31/18 166/55.6

* cited by examiner

*Primary Examiner* — Robert E Fuller
(74) *Attorney, Agent, or Firm* — Pierson Intellectual Property LLC

(57) ABSTRACT

A fishing tool for downhole operations with a collapsible distal end, wherein the collapsible grabber includes catching fingers that have a variable inner diameter.

18 Claims, 5 Drawing Sheets

METHODS AND SYSTEMS FOR A FISHING TOOL

BACKGROUND INFORMATION

Field of the Disclosure

Examples of the present disclosure relate to a fishing tool to retrieve objects. More specifically, embodiments include a fishing tool with a collapsible inner diameter that allows for larger debris, objects, tools, junk, fish, etc. to be removed downhole.

Background

Well drilling and completion are the processes of creating a holes in the ground that allow the trapped hydrocarbons within a geological formation to flow back to surface. During these processes, tools used to create the well can get stuck in the well, preventing the tools from being retrieved back to surface. If the tools can't be retrieved then the well has to be abandoned or side tracked.

Current technology for fishing a stuck tool, includes a fishing tool with a housing with an inner no-go catching mechanism, i.e.: one way expanding thread. These fishing tools catch the stuck tool by lowering and slacking weight over. Hence, mechanically forcing the fishing tool to grab over the stuck tool and locking the stuck tool in place before jarring up trying to free the stuck tool.

Due to the requirement to have an inner no-go catching mechanism and an external housing that contains the catching mechanism, the dimensions of the fishing tool are limited by the internal diameter of the hole and the required fishing tool outside diameter. These limitations create a challenge if the fishing tool has a relatively big diameter compared to the internal diameter of the hole, i.e.: an existing fishing tool will not be able to catch the stuck tool since the no-go inner diameter of the fishing tool will be smaller than the stuck tool diameter.

Accordingly needs exist for systems and methods associated with a fishing tool with a bigger internal diameter and collapsible distal end that allows for moving over a stuck tool, reducing the internal diameter of the fishing tool, and grabbing the stuck tool.

SUMMARY

Embodiments disclosed herein describe systems and methods for a fishing tool with a collapsible grabber. This may enable the grabber to retrieve larger debris, objects, tools, junk, fish, etc. (referred to hereinafter collectively and individually as "fish"). In embodiments, catching fingers associated with a catching tool may be run in hole with a first sized inner diameter that is larger or same as the inner diameter of an opening of the fishing tool, wherein distal ends of the catching fingers are positioned behind the opening of the catching tool. This may allow the size of the opening of the catching tool to not be restricted by the thickness of the catching fingers or the catching tool. Responsive to activating the fishing tool and after a fish is caught and aligned with the ends of the catching fingers within the fishing tool, the catching tool may move toward the distal end of the fishing tool while the housing remains fixed in place. This may cause the catching fingers to have a second sized inner diameter, which is smaller than the first sized inner diameter and the distal end of the housing.

Embodiments of the fishing tool may include a running tool, housing, and catching tool.

The running tool may include a static running tool and a moving running tool. The static running tool may be configured to remain in place and be coupled to the housing. The moving running tool may be coupled to the catching tool, and be configured to move along a linear axis to activate the fishing tool. This may allow the housing to remain fixed in place, while the catching tool moves along the linear axis. In other embodiments this may be reversed, wherein the housing is configured to move towards a proximal end of the fishing tool relative to a static catching tool.

The housing may include a body, rails, and distal end, and may be configured to be coupled to the static running too. The housing may be configured to remain fixed in place along a liner axis while the catching tool moves towards the distal end of the running tool. The body of the housing may be coupled to the static running tool. The rails may be configured to couple the body and the distal end of the housing. Sides of the rails may be configured to adjacent to sides of the catching fingers to limit the relative rotational movement of the housing and catching tool. A first end of the distal end of the housing may include tapered inner sidewalls that decrease an internal diameter across the housing towards the opening of the fishing tool. The tapered sidewalls may be configured to move the distal ends of the catching fingers towards a central axis of the fishing tool responsive to activating the fishing tool.

The catching tool may be configured to move responsive to sliding the moving running tool towards a distal end of the wellbore to activate the fishing tool. The catching tool may include catching fingers that are configured to be positioned between rails of the housing, wherein the ends of the catching fingers are offset from the opening of the fishing tool. The catching fingers may be configured to have a first inner diameter when run in hole, and a second inner diameter when the running tool is activated, wherein the second inner diameter is smaller than the first inner diameter. The catching fingers may include tapered outer sidewalls that interface with the tapered inner sidewalls of the housing. Responsive to activating the fishing tool, the catching tool may move towards a distal end of the fishing tool, towards the opening of the fishing tool. This may align and overlap the tapered inner sidewalls of the housing and the tapered outer sidewalls of the catching fingers. When the tapered sidewalls are aligned and overlapped, the distal ends of the catching fingers may move towards a central axis of the fishing tool, which may allow the inner diameter across the distal ends of the catching fingers to decrease in size while being encompassed by the housing. As such, the catching fingers may be configured to change inner diameters responsive to moving the catching tool, which may allow the catching fingers to transition from having a larger inner diameter to a smaller inner diameter while the object is positioned within the fishing tool.

The slots may be positioned between the proximal ends of the rails and the catching fingers. The slots may be configured to allow the relative movement of the housing and the catching tool, wherein the catching tool moves while the housing remains fixed in place. The length of the slot may change responsive to the fishing tool being activated. While the fishing hole is run in hole, the slot may have a first length creating a space between the proximal end of the rails and the catching fingers. Responsive to the catching tool moving towards the distal end of the fishing tool, a sidewall between adjacent catching fingers may move to occupy the space of the slot to be positioned adjacent to the proximal ends of the corresponding rail, which may cause the tapered inner sidewall of the housing to align the tapered outer sidewalls of the catching fingers.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
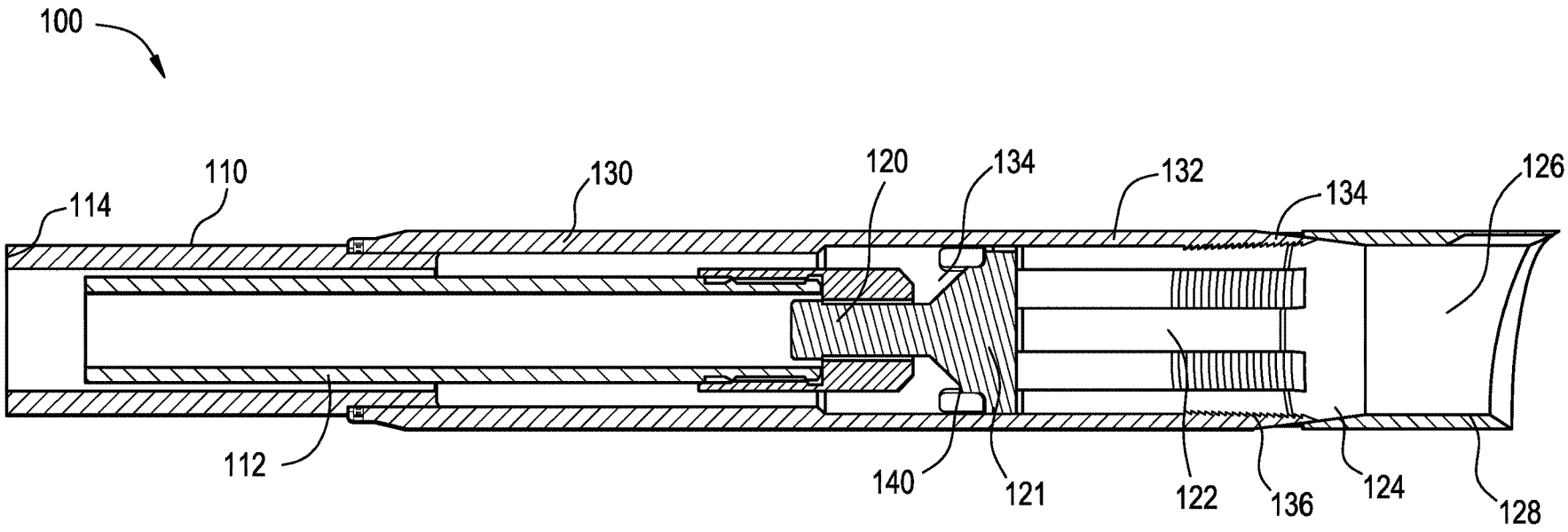
FIGS. 1 and 2 depict a fishing tool in a first mode, according to an embodiment.
Figure 2:
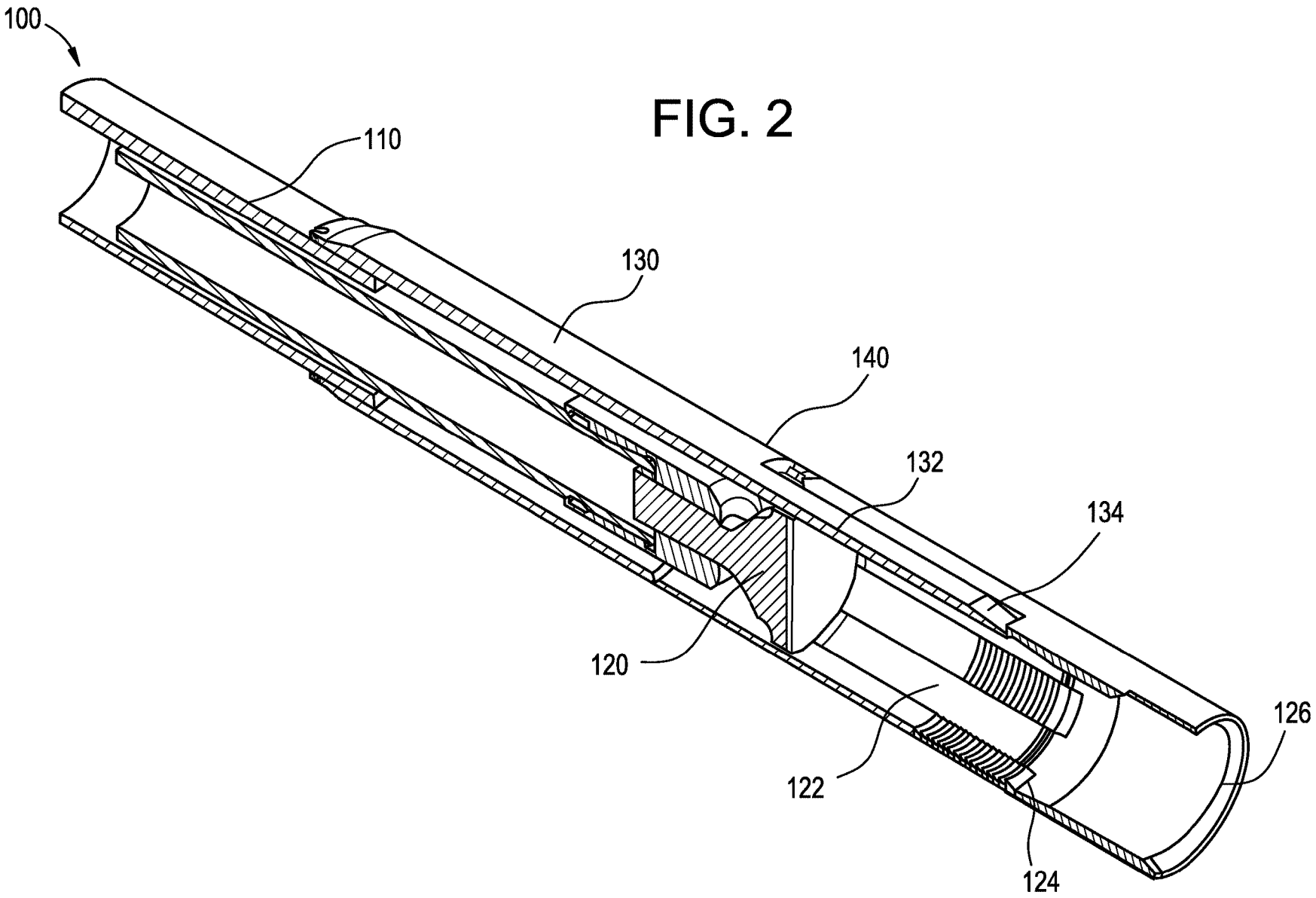

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a fishing tool 100, according to an embodiment. Fishing tool 100 may be configured to grab, retrieve, dislodge, etc. an object positioned downhole, and pull the object to a surface. Fishing tool 100 may include a moving running tool 110, static running tool 112, housing 120, and catching tool 130.

Static running tool 112 may be configured to remain in place while moving running tool 110 moves along an axis. Moving running tool 110 may be configured to be coupled to catching tool 130, and static running tool 112 may be configured to be coupled to housing 120. In embodiments, moving running tool 110 may be configured to receive a force, such as a mechanical, hydraulic or hydrostatic force, to move towards opening 128 of housing 120. Responsive to moving running tool 110 moving towards opening 128, fishing tool 100 may be activated and move from a first mode to a second mode. In embodiments, fishing tool 100 may be run in hole in the first mode and transition to the second mode downhole.

Housing 120 may be coupled to static running tool 112, and be configured to stay in a fixed positioned along a linear axis while moving running tool 110 and catching tool move along the linear axis. Housing 120 may include body 121, rails 122, and opening 128.

Body 121 may be configured to be coupled with static running tool 112. Rails 122 may be configured to couple body 121 to a distal end of housing. First ends of the rails 122 may be coupled to body 121 and second ends of the rails 122 may be coupled to the distal end of housing 120. Rails 122 may be configured to extend substantially in a direction in parallel to a central axis of fishing tool 100. Additionally, the sidewalls of rails 122 may be positioned adjacent to the sidewalls of catching fingers 132 to limit the relative rotational movement of housing 120 and catching tool 130.

Opening 128 of housing 120 may be positioned on a second end of rails 122, at a distal end 126 of fishing tool 100. A first portion of the distal end 126 of fishing tool 100 may include tapered sidewalls 124, wherein the tapered sidewalls 124 gradually decrease an inner diameter across the distal end 126 from the first end of the distal end 126 of fishing tool 100 towards opening 128. Tapered sidewalls 124 may be configured to act as a guide for catching fingers 132, and to compress, shorten, decrease, etc. an inner diameter across the ends of catching fingers 132 responsive to activating fishing tool 100.

Catching tool 130 may be a collet that is configured to grab, pull, and/or retrieve an object from a downhole environment. Catching tool 130 may be configured to be positioned between a first end 114 of fishing tool and the opening 128. In embodiments, catching tool 130 may be configured to be activated to reduce an inner diameter across the ends of catching fingers 132 responsive to moving catching tool 130, while housing 120 remains relatively in place. Catching tool 130 may include catching fingers 132 with tapered sidewalls 136.

Catching fingers 132 may have first ends 134 that are positioned between proximal end 114 and body 121, and second ends that are positioned between a first and second portion of distal end 126. The second ends of catching fingers 132 may include tapered outer sidewalls 136. The tapered outer sidewalls 136 are configured to receive forces from tapered sidewalls 124 to reduce the inner diameter across catching fingers 132 responsive to fishing tool 100 being activated. The tapered outer sidewalls 136 may gradually reduce the outer diameter of catching fingers 132 towards the second end of catching fingers 132. The second end of catching fingers 132 may have internal threads. The internal threads may be configured to assist in grabbing an object downhole.

A slot 140 may be positioned between a first end of adjacent catching fingers 132 and a first end of rails 122. Slot 140 may be configured to receive the first end of rails 122 responsive to fishing tool 100 being activated, wherein the sidewall associated with slot 140 may act as a stop, no-go, etc. to limit the movement of catching fingers 132 towards opening 128.

In other words, slot 140 may be an empty space when run in hole, and the space associated with slot 140 may be occupied with the first end of rails 122 and body 121 responsive to catching tool 130 moving towards the opening 128. As such, responsive to activating fishing tool 100 the first ends of rails 122 and body 121 may be positioned at different, shorter, distance to a sidewall associated with slot 140. Therefore, slot 140 may have first length when run in hole, and a second length with fishing tool 100 is activated, wherein slot 140 is positioned between first ends of rails 122 and catching fingers 132, wherein the second length is shorter than the first length.

Figure 3:
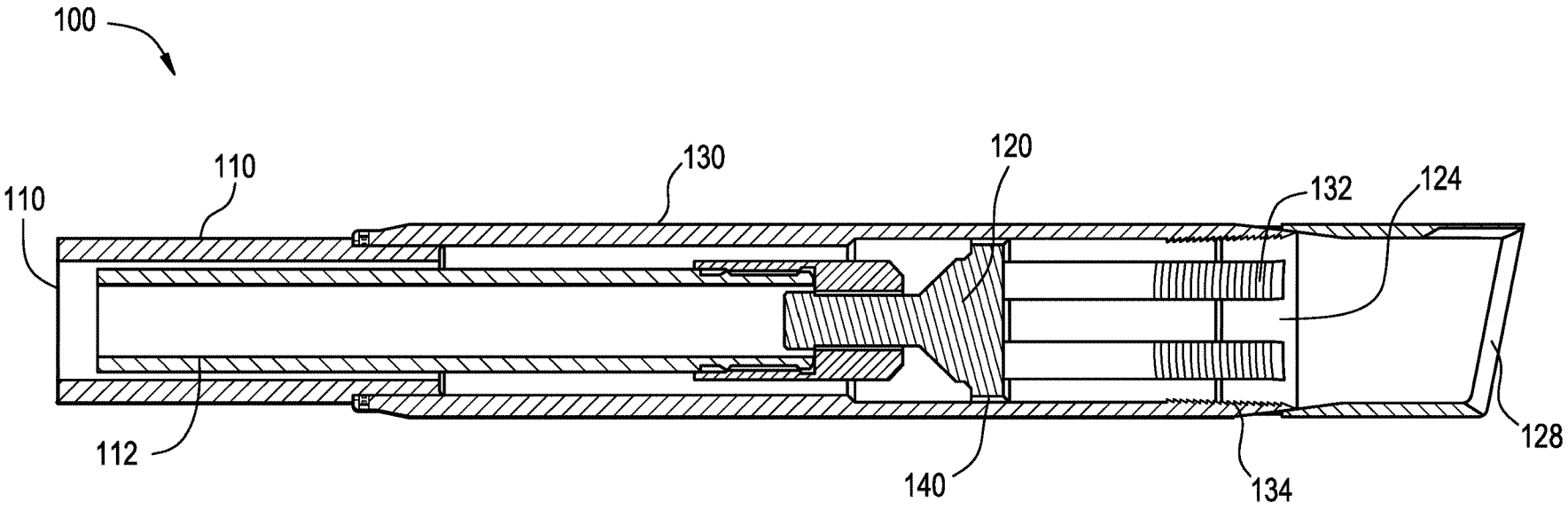
FIGS. 3 and 4 depict a fishing tool in a second mode, according to an embodiment.
Figure 4:
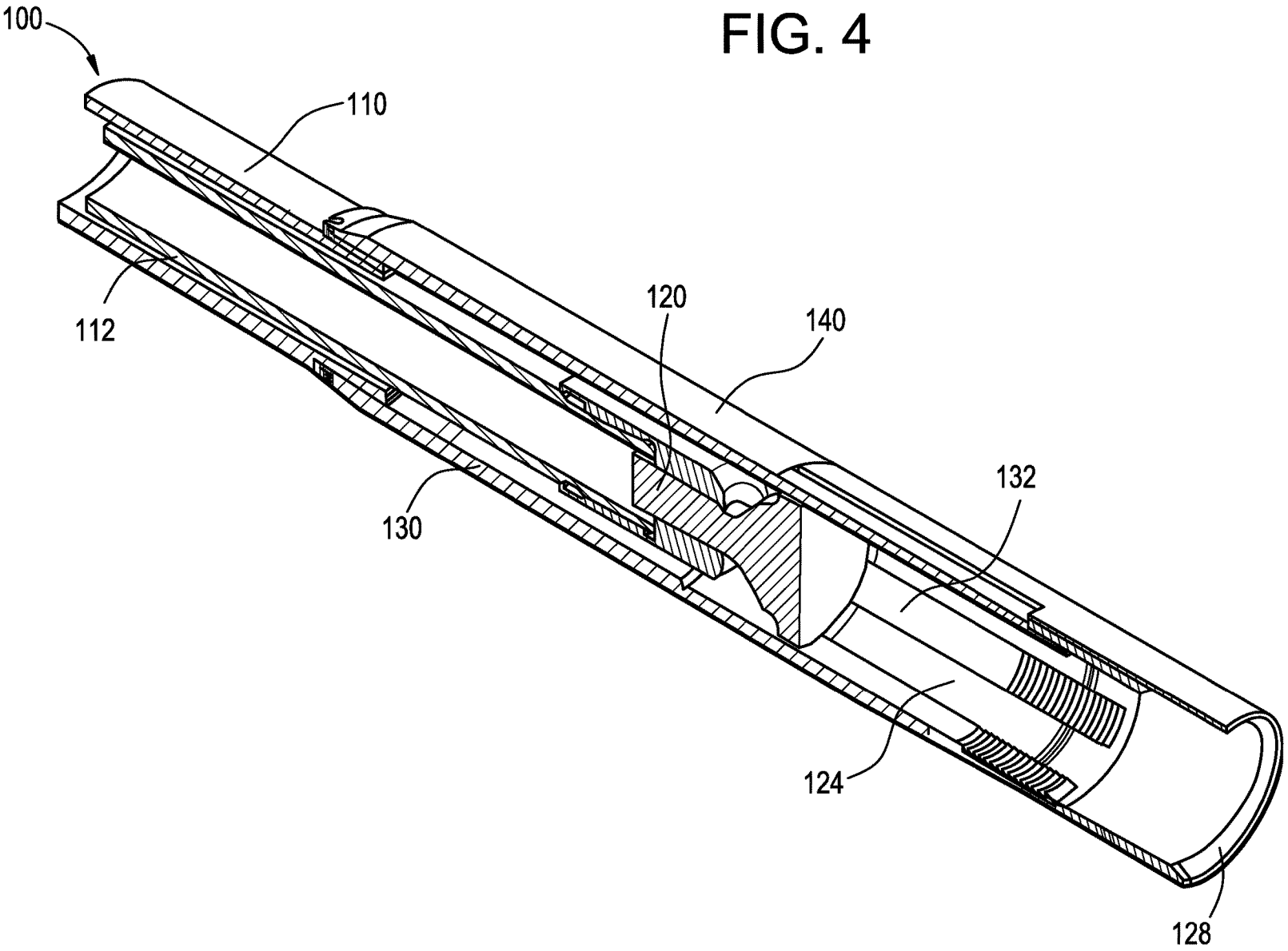

FIGS. 3 and 4 depict a fishing tool 100 when activated, according to an embodiment. Elements depicted in FIGS. 3 and 4 may be described above, and for the sake of brevity a further description of these elements is omitted.

As depicted in FIGS. 3 and 4, fishing tool 100 may be activated by sliding moving running tool 110 and catching tool 130 towards opening 128 along a substantially linear axis, while static running tool 112 and housing 120 remain fixed in place along the linear axis.

Responsive to moving running tool 110 towards opening 128, outer tapered sidewalls 134 associated with catching fingers 132 may also move towards opening 128. This may slide tapered sidewalls 124 associated with housing 120 around tapered sidewalls 136 associated with catching fingers 132, which may push the distal ends of catching fingers 132 towards the central axis of fishing tool 100 reducing the catching fingers 132 internal diameter, wherein the catching fingers 132 operate as catching collets.

By not aligning the distal ends of catching fingers 132 within opening 128, a thickness associated with catching fingers 132 may not impact a size of an object that may enter fishing tool 110. This may enable a large object to enter opening 128, which is positioned further downhole than the distal ends of catching fingers 132. Fishing tool 110 may be activated by moving catching tool 130 towards opening 128 until a sidewall between adjacent catching fingers 132 associated with slot 140 is positioned adjacent to the proximal ends of rails 122. This may allow an inner diameter across catching fingers 132 to decrease in size, grab the object, and fishing tool 100 may be removed from the wellbore.

Figure 5:
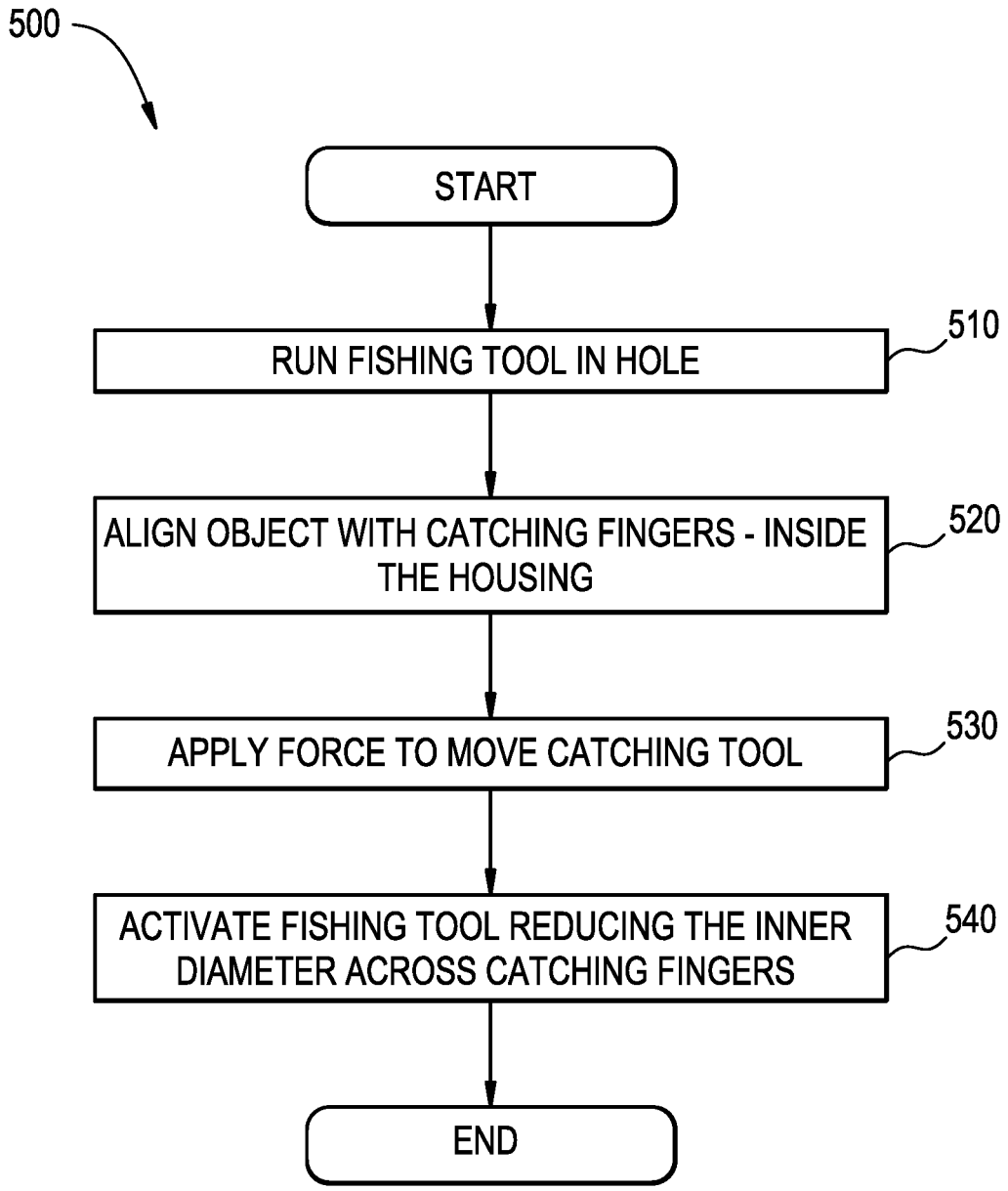
FIG. 5 depicts a method utilizing a fishing tool, according to an embodiment.

FIG. 5 depicts a method 500 for utilizing a fishing tool, according to an embodiment. The operations of method 500 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting.

At operation 510, a fishing tool may be run in hole. When the fishing hole is run in hole, a slot may be created between a proximal end of the rails on a housing and proximal end of catching fingers. This slot may be configured to receive the proximal end of the rails responsive to activating the fishing tool.

At operation 520, an object may enter the opening of the fishing tool and become aligned with the distal end of the catching fingers, wherein the distal end of the catching fingers may have a first inner diameter in a first mode.

At operation 530, a force may be applied against a moving running tool. This force may cause the moving running tool and a catching tool to move towards an opening on the distal end of the fishing tool.

At operation 540, responsive to the catching tool moving, inner tapered sidewalls associated with the housing may interface with outer tapered sidewalls on catching fingers to move the ends of the catching fingers towards a central axis of the fishing tool. This may activate the tool and decrease the inner diameter across the fishing tool. Further, when activating the tool the proximal ends of rails of the housing may be positioned adjacent to a sidewall of a slot.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A fishing tool for oil or gas operations comprising:

a catching tool with catching fingers, wherein an inner diameter associated with the catching fingers is configured to transition from a first inner diameter to a second inner diameter, the first inner diameter being larger than the second inner diameter;

a housing with a body and a distal end;

rails extending between the body and the distal end, wherein the catching fingers are positioned between the rails, wherein an outer surface of the fishing tool includes outer surfaces of the rails and outer surfaces of the catching fingers: and a slot configured to receive a first end of the rails when the catching fingers have the second inner diameter.

2. The fishing tool of claim 1, further comprising:

a moving running tool coupled to the catching tool, wherein the moving running tool is configured to receive a hydraulic force and transfer a shifting force to the catching tool, wherein responsive to the catching tool receiving the shifting force the catching fingers move axially towards an opening in the housing, while the housing remains in a static position.

3. The fishing tool of claim 1, wherein the housing is configured to remain in place while the catching tool moves towards a distal end of the fishing tool, wherein the inner diameter associated with the catching fingers transition from the first inner diameter to the second inner diameter responsive to moving the catching tool, wherein distal ends of the catching fingers are positioned between a proximal end of the fishing tool and an opening of the housing.

4. The fishing tool of claim 1, further comprising:

internal tapered sidewalls positioned on the distal end of the housing;

external tapered sidewalls positioned on an end of the catching fingers.

5. The fishing tool of claim 4, wherein the external tapered sidewalls are exposed when running the fishing tool in hole.

6. The fishing tool of claim 5, wherein the external tapered sidewalls are encompassed by the internal tapered sidewalls when the fishing tool is pulled out of the hole.

7. The fishing tool of claim 1, wherein the internal tapered sidewalls and the external tapered sidewalls are configured to be positioned adjacent to each other when the catching fingers have the second inner diameter.

8. The fishing tool of claim 1, wherein the slot has a first length when the catching fingers have the first inner diameter and a second length when the catching fingers have the second inner diameter.

9. The fishing tool of claim 1, wherein a length associated with the rails is shorter than a length associated with the catching fingers.

10. A method associated with a fishing tool for oil or gas operations comprising:

transitioning an inner diameter associated with catching fingers on a catching tool from a first inner diameter to a second inner diameter, the first inner diameter being larger than the second inner diameter;

positioning the catching fingers between rails on a housing, the housing including a body and a distal end, wherein the rails extending between the body and the distal end, wherein an outer surface of the fishing tool includes outer surfaces of the rails and outer surfaces of the catching fingers;

positioning a first end of the rails within a slot when the catching fingers have the second inner diameter.

11. The method of claim 10, further comprising:

coupling the catching tool to a moving running tool;

applying a hydraulic force to the moving running tool;

transferring a shifting force to the catching tool responsive to the hydraulic force being applied to the moving running tool;

axially moving the catching fingers towards an opening in the housing while the housing remains in a static positions based on the shifting force.

12. The method of claim 10, further comprising:

moving the catching tool towards a distal end of the fishing tool while the housing remains in place;

transitioning the inner diameter associated with the catching fingers from the first inner diameter to the second inner diameter responsive to moving the catching tool, wherein distal ends of the catching fingers are positioned between a proximal end of the fishing tool and an opening of the catching tool.

13. The method of claim 10, wherein the housing includes internal tapered sidewalls positioned on the distal end of the housing, and the catching fingers include external tapered sidewalls positioned on an end of the catching fingers.

14. The method of claim 13, further comprising:

exposing the external tapered sidewalls when running the fishing tool in hole.

15. The method of claim 14, further comprising:

encompassing the external tapered sidewalls by the internal tapered sidewalls when the fishing tool is pulled out of the hole.

16. The method of claim 10, further comprising:

positioning the internal tapered sidewalls and the external tapered sidewalls adjacent to each other when the catching fingers have the second inner diameter.

17. The method of claim 10, wherein the slot has a first length when the catching fingers have the first inner diameter and a second length when the catching fingers have the second inner diameter.

18. The method of claim 10, wherein a length associated with the rails is shorter than a length associated with the catching fingers.

* * * * *